United States Patent [19]

Maruhashi et al.

[11] Patent Number: 4,581,066

[45] Date of Patent: Apr. 8, 1986

[54] CORROSION RESISTANT ALLOY

[75] Inventors: Shigeaki Maruhashi; Kazuo Hoshino; Yoshihiro Uematsu; Katsuhisa Miyakusu; Takehiko Fujimura, all of Yamaguchi, Japan

[73] Assignee: Nisshin Steel Co., Ltd., Tokyo, Japan

[21] Appl. No.: 638,453

[22] PCT Filed: Dec. 27, 1983

[86] PCT No.: PCT/JP83/00458

§ 371 Date: Jul. 24, 1984

§ 102(e) Date: Jul. 24, 1984

[87] PCT Pub. No.: WO84/02536

PCT Pub. Date: Jul. 5, 1984

[30] Foreign Application Priority Data

Dec. 29, 1982 [JP] Japan ..... 57-230832

[51] Int. Cl.[4] ..... C22C 38/06

[52] U.S. Cl. ..... 75/124; 75/126 K; 75/128 P

[58] Field of Search ..... 75/124 C, 124 F, 126 K, 75/128 P, 125; 148/37, 12 EA

[56] References Cited

U.S. PATENT DOCUMENTS 2,897,078 7/1959 Nishikiori ..... 75/124

FOREIGN PATENT DOCUMENTS 52-24913 2/1977 Japan ..... 75/124

54-128421 10/1979 Japan ..... 75/126 K

*Primary Examiner*—L. Dewayne Rutledge

*Assistant Examiner*—Deborah Yee

*Attorney, Agent, or Firm*—Wenderoth, Lind & Ponack

[57] ABSTRACT

A corrosion resistant alloy comprising in % by weight up to 0.05% of C, 10.00 to 18.00% of Cr, up to 1.00% of Si, up to 1.00% of Mn, more than 0.040% but not more than 0.150% of P, up to 0.050% of S, up to 0.60% of Ni and 0.005 to 0.50% of sol.Al, the balance being Fe and unavoidable impurities. The alloy has an enhanced pickling performance of the hot rolled material and an improved workability of the cold rolled material.

4 Claims, 1 Drawing Figure

CORROSION RESISTANT ALLOY

TECHNICAL FIELD OF THE INVENTION

The present invention relates to a corrosion resistant alloy.

BACKGROUND OF THE INVENTION

As general corrosion resistant materials there are stainless steels containing at least 11.00% of Cr, and in JIS G 4304 they are classified, depending upon their metallic structures, into five varieties, that is, austenitic, austeniteferritic, ferritic, martensitic and precipitation hardenable stainless steels. Among them ferritic stainless steels are relatively inexpensive and have enhanced workability and elongation, and therefore relatively large quantites of such steels are commercially used. Of the ferritic stainless steels, nine species of hot rolled sheets and ten species of hot rolled strips are standardized. Ten species of cold rolled sheets and strips are also standardized. Regarding the content of P of these standardized ferritic stainless steel sheets and strips, the standard prescribes 0.030% or less of P for two species of SUS 447 J1 and SUS XM 27 and 0.040% or less of P for other species.

A ferritic stainless steel has a crystalline structure of a body-centered cubic lattice which inherently leads to a reduced toughness and workability of the material. In addition, Cr contained in the material in an amount as high as at least 11.00% to provide the corrosion resistance also inherently acts to further reduce the toughness and workability of the material. Accordingly, regarding impurities which adversely affect the toughness and workability of the material, in particular P, the standard prescribes the strict provision of 0.040% or less of P.

In the production of thin products having a thickness of 4.0 mm or below, it has now been found according to the inventors' research that an adverse effect of P in excess of 0.040% upon the toughness of the products may be obviated by controlling amounts of Cr, C and sol. Al within appropriate ranges, respectively, and thus, it is possible to inexpensively supply corrosion resistant materials without sacrificing the corrosion resistance and mechanical properties of the products.

In producing stainless steels individual companies utilize their respective processes which basically involve melting of iron scraps, iron alloys and other materials in a electric furnace, refinining and adjustment of components in VOD, converter-VOD or AOD and casting of slubs and ingots. On the other hand, from a view point of productivity and saving energy, is also considered a process for producing stainless steels using an installation for the manufacture of ordinary steels wherein pig iron from a blast furnace is fed to a converter together with various subsidiary materials such as Fe-Cr alloys, in which converter refining and component adjustment are carried out. The pig iron normally contains substantial amounts of impurities such as P and S, and in particular 0.08 to 0.15% of P. In order that the product should contain a reduced level of P as low as 0.040% or below as in the standardized stainless steels, it is necessary to carry out a preliminary removal of P before the pig iron is fed to the converter or to carry out a special treatment for the removal of P in operating the converter, leading to a reduction of the productivity. If such treatments for removing P may be obviated, the productivity will be enhanced and the manufacturing costs will be reduced, rendering the process inexpensive. Accordingly, it can be understood that if the burden of controlling P prescribed in the standard of stainless steels may be lightened, it is possible to produce corrosion resistant alloys reduced in cost.

DESCRIPTION OF THE INVENTION

As a result of extensive research and consideration, the inventors have found that if Cr and C are restricted to from 10.00 to 18.00% and up to 0.05%, and if 0.005 to 0.50% of sol. Al is added, the presence of P in excess of the level required in the standardized ferritic stainless steels does not adversely affect the toughness of the materials. It has also been found that the enrichment of P proposed herein does not adversely affect the corrosion resistance of the materials, rather it improves the pickling performance of hot rolled products as well as the workability, such as an ability of products of being deeply drawn.

The invention is based on such discoveries and provides novel corrosion resistant alloys.

Thus, in accordance with the invention, there is provided a corrosion resistant alloy having an excellent workability and pickling performance which comprises in % by weight up to 0.05% of C, 10.00 to 18.00% of Cr, up to 1.00% of Si, up to 1.00% of Mn, more than 0.040% but not more than 0.150% of P, advantageously 0.045 to 0.150% of P, up to 0.050% of S, up to 0.60% of Ni and 0.005 to 0.50% of sol. Al, and optionally one or both of up to 1.00% of Cu and up to 1.00% of Mo, and further optionally one or both of up to 0.05% of Ti and up to 0.50% of Nb in an amount of up to 0.50% in total, the balance being Fe and unavoidable impurities.

The reasons for the numerical restrictions of the alloying elements are as follows.

C should be up to 0.05%. If C is excessively high, a transformation phase locally formed after hot rolling tends to be unduly rigid. This fact cooperates with the enrichment of P not only to impair the toughness and elongation of the material as hot rolled but also to adversely affect the toughness, workability and weldability of the cold rolled and annealed product. To avoid these inconveniences it is required to set the upper limit of C, 0.05%.

Cr should be from 10.00 to 18.00%. The lower limit of 10.00% of Cr is required to achieve the corrosion resistance. An excessively high Cr impairs the toughness of the material, and cooperates with the enrichment of P to result in an undesirably brittle product. For this reason the upper limit of Cr is set 18.00%.

Si and Mn each may be present in an amount of up to 1.00% as normally permitted in stainless steels.

A high content of S tends to adversely affect the corrosion resistance and hot workability of the material. Thus, the lower the content of S the more preferable. The allowable upper limit of S is not set at 0.050%, considering the fact that pig iron from a blast furnace contains a substantial amount of S and intending to use such pig iron without any treatment for the removal of S.

Ni has an effect to improve the toughness of ferritic materials. But a high content of Ni renders the product expensive. Accordingly, the upper limit of Ni prescribed with normal ferritic stainless steels is adopted as the allowable limit of Ni in alloys according to the invention. Thus, Ni is now set at up to 0.06%.

The content of P constitutes one of the essential features of the invention. With not more than 0.040% of P, a preliminary removal of P from pig iron or a special treatment for the removal of P in the converter is required, and therefore, an advantage of inexpensive production of corrosion resistance alloy is lost. In addition an effect of an improved workability and pickling performance owing to the enrichment of P according to the invention is not enjoyed. Accordingly, more than 0.040% of P, advantageously at least 0.045% of P is required. On the other hand, the presence of P in excess of 0.150% is not preferred from a view point of the toughness and hot workability and also tends to lower the cold workability. The upper limit of P is now set at 0.150%.

Soluble Al contributes to compensate a reduction of the toughness due to the enrichment of P to some extent and to improve the workability. Such effects are insufficient with less than 0.005% of sol. Al. With more than 0.50% of sol. Al, such effects tend to be saturated and the product becomes expensive. For these reasons, the content of sol. Al is set from 0.005 to 0.50%.

Cu and Mo each has an effect to improve the corrosion resistance. But inclusion of such an element in an excessively high amount renders the product expensive. The upper limit of Cu and Mo each is now set at 1.00%.

Ti and Nb each forms compounds with C or N and is effective as a stabilizing element to improve the toughness, corrosion resistance, in particular resistance to intergranular corrosion, and mechanical properties. But with more than 0.50% such effects tends to be saturated and the product becomes expensive. Accordingly, the upper limit of Ti and Nb is set at 0.50% in total.

BRIEF EXPLANATION OF THE DRAWINGS

The sole drawing.

Figure 1:
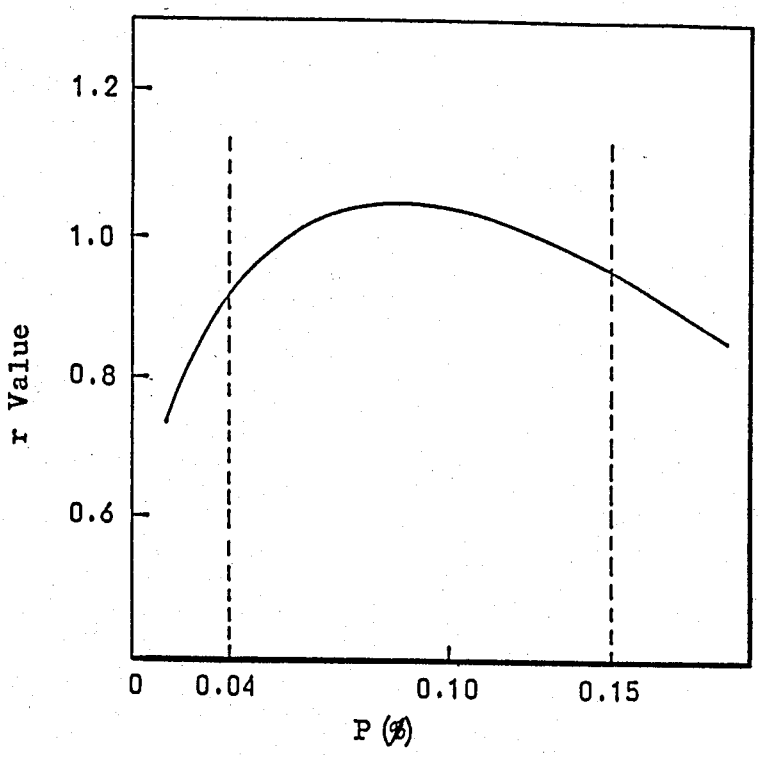
FIG. 1 is a graph showing an effect of P on the r value.

The results shown in FIG. 1 were obtained on samples prepared from various starting corrosion resistant alloys basically containing 13% of Cr, 0.02% of C, 0.01% of N, 0.005 to 0.50% of sol. Al, up to 1.00% of Si, up to 1.00% of Mn, up to 0.050% of S and up to 0.60% of Ni as well as various amounts of P by hot rolling each starting alloy in a conventional manner, and thereafter without annealing the hot rolled sheet descaling it, subjecting the descaled sheet to a single step of cold drawing and subjecting the cold rolled sheet to a finish anneal comprising even heating of the sheet at a temperature of 820° C. for one minute and allowing it to cool in air.

BEST MODE FOR CARRYING OUT THE INVENTION

Properties of steel alloys in accordance with the invention will now be illustrated by the following working and control examples.

Molten steels having chemical compositions indicated in Table 1 were prepared. From each molten steel a hot rolled steel strip having a thickness of 3.2 mm was prepared. A piece of the hot rolled strip was descaled by pickling, and thereafter cold rolled to a thickness of 0.7 mm without any intermediate anneal, and then subjected to a finish annealing comprising even heating at a temperature of 820° C. for one minute and allowed to cool in air. The so prepared pieces of hot rolled and cold rolled strips were tested in the following Examples.

TABLE 1

| | | Chemical Composition of Steels Used In Examples (% by weight) | | | | | | | | | | | | | |
|---|---|---|---|---|---|---|---|---|---|---|---|---|---|---|---|
| Steel | Classification | C | Si | Mn | P | S | Cr | Ni* | Mo* | Cu* | Ti* | Nb* | sol. Al | N | Balance |
| A | according to the invention | 0.014 | 0.19 | 0.20 | 0.053 | 0.007 | 11.53 | — | — | — | — | — | 0.024 | 0.008 | Fe and unavoidable impurities |
| B | according to the invention | 0.020 | 0.18 | 0.23 | 0.087 | 0.005 | 11.48 | — | — | — | — | — | 0.035 | 0.010 | Fe and unavoidable impurities |
| C | according to the invention | 0.013 | 0.21 | 0.19 | 0.130 | 0.006 | 11.76 | — | — | — | — | — | 0.047 | 0.007 | Fe and unavoidable impurities |
| D | according to the invention | 0.043 | 0.47 | 0.25 | 0.068 | 0.004 | 16.71 | — | — | — | — | — | 0.130 | 0.012 | Fe and unavoidable impurities |
| E | according to the invention | 0.023 | 0.34 | 0.20 | 0.075 | 0.003 | 17.27 | — | 0.80 | — | — | — | 0.050 | 0.007 | Fe and unavoidable impurities |
| F | according to the invention | 0.031 | 0.40 | 0.23 | 0.082 | 0.005 | 17.83 | 0.30 | — | 0.50 | — | — | 0.018 | 0.010 | Fe and unavoidable impurities |
| G | according to the invention | 0.026 | 0.33 | 0.27 | 0.078 | 0.004 | 16.49 | — | — | — | 0.15 | — | 0.020 | 0.012 | Fe and unavoidable impurities |
| H | according to the invention | 0.018 | 0.37 | 0.18 | 0.095 | 0.010 | 16.50 | — | — | — | — | 0.42 | 0.032 | 0.011 | Fe and unavoidable impurities |
| I | according to the invention | 0.047 | 0.42 | 0.21 | 0.080 | 0.032 | 16.23 | — | — | — | — | — | 0.350 | 0.009 | Fe and unavoidable impurities |
| J | accroding to the invention | 0.014 | 0.35 | 0.29 | 0.073 | 0.003 | 17.52 | — | 0.92 | — | — | 0.44 | 0.020 | 0.012 | Fe and unavoidable impurities |
| K | Control | 0.018 | 0.20 | 0.18 | 0.023 | 0.005 | 11.43 | — | — | — | — | — | 0.021 | 0.009 | Fea and unavoidable impurities |
| L | " | 0.015 | 0.17 | 0.20 | 0.182 | 0.006 | 11.80 | — | — | — | — | — | 0.004 | 0.010 | Fe and unavoidable impurities |

TABLE 1-continued

| Steel | Classification | C | Si | Mn | P | S | Cr | Ni* | Mo* | Cu* | Ti* | Nb* | sol. Al | N | Balance |
|---|---|---|---|---|---|---|---|---|---|---|---|---|---|---|---|
| | | Chemical Composition of Steels Used In Examples (% by weight) | | | | | | | | | | | | | |
| M | " | 0.075 | 0.24 | 0.27 | 0.085 | 0.009 | 11.68 | — | — | — | — | — | 0.003 | 0.012 | Fe and unavoidable impurities |
| N | " | 0.047 | 0.42 | 0.23 | 0.027 | 0.008 | 16.66 | — | — | — | — | — | 0.004 | 0.013 | Fe and unavoidable impurities |
| O | " | 0.040 | 0.40 | 0.21 | 0.070 | 0.005 | 20.52 | — | — | — | — | — | 0.003 | 0.008 | Fe and unavoidable impurities |
| P | " | 0.018 | 0.29 | 0.22 | 0.020 | 0.003 | 17.41 | — | 0.95 | — | — | — | 0.005 | 0.008 | Fe and unavoidable impurities |
| Q | " | 0.030 | 0.46 | 0.27 | 0.021 | 0.005 | 17.80 | 0.25 | — | 0.48 | — | — | 0.003 | 0.012 | Fe and unavoidable impurities |
| R | " | 0.025 | 0.37 | 0.20 | 0.026 | 0.005 | 16.79 | — | — | — | 0.18 | — | 0.018 | 0.016 | Fe and unavoidable impurities |
| S | " | 0.022 | 0.35 | 0.26 | 0.022 | 0.004 | 16.60 | — | — | — | — | 0.39 | 0.021 | 0.008 | Fe and unavoidable impurities |
| T | " | 0.043 | 0.34 | 0.20 | 0.023 | 0.008 | 16.73 | — | — | — | — | — | 0.420 | 0.013 | Fe and unavoidable impurities |
| U | " | 0.013 | 0.30 | 0.25 | 0.024 | 0.00 | 17.96 | — | 0.97 | — | — | 0.45 | 0.010 | 0.009 | Fe and unavoidable impurities |

*Blanks for Ni, Mo, Cu, Ti and Nb indicate an amount included as impurities

EXAMPLE 1

Samples of hot rolled strips of steels B and D according to the invention and control steels K, L, M, N and O indicated in Table 1, were tested for the Charpy impact values at 20° C. The results are shown in Table 2.

TABLE 2

| Steel | Classification | Impact Value (kg · m/cm$^2$) |
|---|---|---|
| B | according to this invention | 12.6 |
| D | according to this invention | 10.3 |
| K | control | 14.5 |
| L | control | 6.8 |
| M | control | 5.4 |
| N | control | 11.7 |
| O | control | 4.6 |

As revealed from the results shown in Table 2, steels B and D according to the invention have impact values slightly lower than but comparable to those of control steels K and N having a reduced P content, respectively. In contrast, control steels L, M and O containing P, C and Cr in excess of the ranges prescribed herein, respectively, and having an insufficient sol.Al content, have a remarkably reduced toughness as reflected by their low impact values.

EXAMPLE 2

Samples of cold rolled strips of steels A, B, C and D according to the invention and control steels K, L and N indicated in Table 1 were tested for their mechanical properties, r value, Ericksen value and CCV (conical cup value). The results are shown in Table 3.

TABLE 3

| Steel | Classification | 0.2% Proof* (kg/mm$^2$) | Tensile strength* (kg/mm$^2$) | Elongation* (%) | r value* | Erichsen value (mm) | CCV |
|---|---|---|---|---|---|---|---|
| A | according to this invention | 24.2 | 42.3 | 31.8 | 0.95 | 10.2 | 28.2 |
| B | according to this invention | 26.9 | 44.2 | 31.7 | 1.02 | 10.3 | 27.9 |
| C | according to this invention | 31.3 | 46.5 | 29.1 | 1.03 | 10.1 | 28.0 |
| D | according to this invention | 34.6 | 50.9 | 28.2 | 1.16 | 10.2 | 28.1 |
| K | control | 20.1 | 40.1 | 30.5 | 0.78 | 9.7 | 28.8 |
| L | " | 35.6 | 47.6 | 26.7 | 0.75 | 8.5 | 29.2 |
| N | " | 32.0 | 50.1 | 27.9 | 0.86 | 9.4 | 29.0 |

*Weight average of test values in the directions of 0°, 45° and 90° relative to the direction of rolling. For example, $r = (r_0 + 2\,r_{45} + r_{90})/4$ wherein $r_0$, $r_{45}$ and $r_{90}$ are test values of r in the direction of 0°, 45° and 90° relative to the direction of rolling, respectively.

Steels A, B and C according to the invention and control steels K and L are construed as having substantially the same components other than P. By comparing the properties of these groups of steels the effect of P will be clearly understood.

Specifically, with control steel K having a reduced P content, the r value, which is a measure of the ability of the material of being deeply drawn, is low, and the Erichsen value and CCV, which are test values indicating the ability of the material of being shaped into articles, are not satisfactory (The greater the CCV, the worse the shapability). In contrast, steels A, B and C having P enriched according to the invention exhibit better r, Erichsen and conical cup values than those of control steel K, demonstrating a substantial improvement of the workability achieved by the enrichment of P proposed herein. These steels according to the invention also exhibit satisfactory elongation and toughness. However, with control steel L having P excessively enriched beyond the range prescribed herein, the parameters again become worse, indicating reduced toughness and workability. Accordingly, it can be understood that in order to improve the workability without sacrificing the toughness by the enrichment of P, there is a critical range of P as proposed herein.

Improvement of the workability achieved by the enrichment of P may be also understood by comparing steel D according to the invention with control steel N. Steels D and N having different amounts P to each other have substantially different amounts of Cr, C and Si from the above-mentioned steels A, B, C, K and L. Steel D having P enriched according to the invention have better r, Erichsen and CC values than those of control steel N, demonstrating an improved workability of steel D. Steel D also has an elongation and toughness which are comparable to or even better than those of steel N.

Thus, it can be understood that even when amounts of components including Cr and C are changed, if such changes are with the range prescribed herein, the workability may also be effectively improved by the enrichment of P proposed herein without sacrificing the toughness.

EXAMPLE 3

Samples of hot rolled strips of the same steels used in Example 2 were tested for the pickling performance. The results are shown in Table 4.

In the commercial production line a hydrochloric acid pickling liquid is normally employed for pickling hot rolled strips or sheets of ordinary steels. However, in the case of ferritic stainless steels whose pickling performance is substantially worse than that of ordinary steels, satisfactory results are not obtained using a hydrochloric acid pickling liquid. Accordingly, in the step of pickling hot rolled strips or sheets of ferritic stainless steels a stronger pickling liquid, nitric acid, is normally employed, and in addition for the purpose of obtaining better results it has been generally practiced to impose mechanical shock, e.g. by shot beaning, upon scales (oxide layers) on the surfaces of the material before it is dipped in the pickling liquid. As a consequence, costs involved in pickling are substantially higher with ferritic stainless steels than with ordinary steels.

Simulating inexpensive pickling conditions for ordinary steels the tests were carried out using a hydrochloric acid pickling liquid. In a pickling liquid having a free HCl concentration of 90 g/l and a total Fe (added as $FeCl_2$) concentration of 100 g/l, maintained at a temperature of 80° C., samples of hot rolled strips were dipped. At the end of the period indicated in Table 4, each sample was removed from the liquid, and washed with water. The extent of the removal of scales was visually estimated.

TABLE 4

| Steel | Classification | Dipping time (seconds) 60 | 80 | 100 | 120 |
|---|---|---|---|---|---|
| A | according to the invention | X | Δ | Δ | O |
| B | according to the invention | X | Δ | O | O |
| C | according to the invention | Δ | O | O | O |
| D | according to the invention | X | Δ | Δ | O |
| K | control | X | X | X | Δ |
| L | " | Δ | O | O | O |
| N | " | X | X | X | Δ |

Rating:
O: good
Δ: fair
X: bad

By comparing the results obtained with steels A, B, C and D according to the invention with those obtained with control steels K, L and N, the effect of P upon the pickling performance will be understood. Specifically, control steels having a reduced P content cannot be completely descaled even after dipped in the pickling liquor for a period of 120 seconds. In contrast, steels A, B, C and D according to the invention as well as control steel L having P enriched exhibit a shortened period of time required for the complete removal of scales, demonstrating their enhanced pickling performance. It can be understood that the pickling performance of the hot rolled material is enhanced as the content of P increases.

The results demonstrated in this Example are important from viewpoint of productivity. Pickling of a hot rolled material is an indispensable step carried out prior to cold rolling steps, and is normally carried out by continuously passing the hot rolled material through a vessel containing a pickling liquor. The fact that hot rolled strips of steels according to the invention have an enhanced pickling performance and require a shortened pickling time indicates a possibility of highering the rate of passing the material through the pickling step, leading to a substantial improvement of the productivity. It should also be noted that the above-discussed results were obtained using a hydrochloric acid pickling liquid. This Example reveals the fact that steels according to the invention can be advantageously pickled under inexpensive conditions normally employed for pickling ordinary steels.

EXAMPLE 4

Samples of cold rolled strips of steels E, F, I, N, P, Q and T were tested for their pitting potential and corrosion loss loss of weight. The results are shown in Table 5.

TABLE 5

| Steel | Classification | Pitting potential* Vc 200 (Vsce) | Corrosion loss** of weight ($g/m^2 \cdot hr$) |
|---|---|---|---|
| E | according to this invention | 0.27 | 0.49 |
| F | according to this invention | 0.25 | 0.61 |
| I | according to this invention | 0.13 | 1.10 |
| N | control | 0.13 | 1.25 |
| P | " | 0.28 | 0.51 |
| Q | " | 0.25 | 0.60 |

TABLE 5-continued

| Steel | Classification | Pitting potential* Vc 200 (Vsce) | Corrosion loss** of weight ($g/m^2 \cdot hr$) |
|---|---|---|---|
| T | " | 0.14 | 1.04 |

*1000 ppm of $Cl^-$, 80° C., evacuated with Ar

**Loss of weight after dipped in 5% NaCl + 2%$H_2O_2$, at 40° C. for 24 hours.

Control steels P and Q contain Mo and Cu added to improve the corrosion resistance, respectively. Steels E and F having P enriched according to the invention exhibit a pitting potential and corrosion loss of weight comparable to those of control steels P and Q and have an apparently better corrosion resistance when compared with control steel N. It can be understood that the effect of Mo or Cu to improve the corrosion resistance of ferritic stainless steels is recognized irrespective of whether or not the P content exceeds 0.040%.

When the results obtained with steel I according to the invention, which contains 0.350% of Al, are compared with those obtained with control steel T containing 0.420% of Al, it can be understood that although the effect of Al upon the pitting potential and corrosion loss of weight is not clear, the corrosion resistance is not substantially affected by the enrichment of P.

EXAMPLE 5

Samples of cold rolled strips of steel G, H, J, N, R, S and U indicated in Table 1 were tested for the corrosion loss of weight, resistance to intergranular corrosion and resistance to stress corrosion cracking. The results are shown in Table 6.

TABLE 6

| Steel | Classification | Corrosion loss* of weight ($g/m^2 \cdot hr$) | Intergranular corrosion test** | Stress corrosion cracking test*** |
|---|---|---|---|---|
| G | according to this invention | 0.80 | O | O |
| H | according to this invention | 0.78 | O | O |
| J | according to this invention | 0.33 | O | O |
| N | control | 1.25 | X | O |
| R | " | 0.81 | O | O |
| S | " | 0.80 | O | O |

TABLE 6-continued

| Steel | Classification | Corrosion loss* of weight ($g/m^2 \cdot hr$) | Intergranular corrosion test** | Stress corrosion cracking test*** |
|---|---|---|---|---|
| U | " | 0.30 | O | O |

*Same conditions as used in Example 4.

**Samples were sensitized by keeping them at 1200° C. for 10 minutes followed by air cooling and then tested. Sulfuric acid-copper sulfate test in accordance with JIS G 0575. Bend condition: 0.5 tR bend.

Rating:

O: no intergranular corrosion

X; occurrence of intergranular corrosion

***Constant strain method.

42% magnesium chloride test in accordance with JIS A 0576.

Rating:

O; no cracking

X; occurrence of crackings

Control steels R, S and U correspond to steel N having Ti, Nb and Ti+Nb added, respectively. As revealed from Table 6, steels R, S and U have a reduced corrosion loss of weight when compared with steel N, realizing the known effect of Ti and Nb to improve the corrosion resistance. Similar improved results obtained by addition of Ti or Nb are observed with steels G, H and J having P enriched in accordance with the invention.

Steels G, H and J according to the invention having C and N stabilized by the added Ti or Nb, also exhibit an excellent resistance to intergranular corrosion.

It is well known in the art that austenitic stainless steels frequently pose a problem of stress corrosion cracking and that P adversely affects the resistance of the material to stress corrosion cracking. In contrast, steels according to the invention having a body-centered cubic lattice exhibit an excellent resistance to stress corrosion cracking, as revealed in Table 6, inspite of the fact that they are enriched with P.

As described above, the invention has provided corrosion resistant alloys having improved workability and pickling performance.

We claim:

1. A corrosion resistant alloy having enhanced pickling performance when hot rolled and improved workability when cold rolled and annealed said alloy consisting essentially of in % by weight of: up to 0.05% of C, 10.00 to 18.00% of Cr, up to 1.00% of Si, up to 1.00% of Mn, more than 0.040% but not more than 0.150% of P, up to 0.050% of S, up to 0.60% of Ni and 0.005% of sol. Al, the balance being Fe and unvoidable impurities.

2. The corrosion resistant alloy as set forth in claim 1 which contains P in an amount of from 0.045 to 0.15%.

3. A corrosion resistant alloy having enhanced pickling performance when hot rolled and improved workability when cold rolled and annealed, said alloy consisting essentially of in % by weight of: up to 0.05% of C, 10.00 to 18.00% of Cr, up to 1.00% of Si, up to 1.00% of Mn, more than 0.040% but not more than 0.150% of P, up to 0.050% of S, up to 0.60% of Ni, 0.005 to 0.50% of sol. Al and one or both of up to 0.50% of Ti and up to 0.50% of Nb in an amount of up to 0.50% in total, the balance being Fe and unavoidable impurities.

4. The corrosion resistant alloy as set forth in claim 3 which contains P in an amount of from 0.045 to 0.15%.

* * * * *